US009021684B2

(12) United States Patent
Lenker et al.

(10) Patent No.: US 9,021,684 B2
(45) Date of Patent: May 5, 2015

(54) METHOD OF FABRICATING A SLIP RING COMPONENT

(75) Inventors: William Gary Lenker, Marysville, PA (US); Gregory Gordon Griffith, Carlisle, PA (US); Edward John Howard, Millersburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 187 days.

(21) Appl. No.: 13/089,651

(22) Filed: Apr. 19, 2011

(65) Prior Publication Data

US 2012/0270415 A1 Oct. 25, 2012

(51) Int. Cl.

| | |
|---|---|
| ***H01R 43/06*** | (2006.01) |
| ***H01R 43/10*** | (2006.01) |
| ***H01R 39/08*** | (2006.01) |
| *H01R 39/14* | (2006.01) |
| *H01R 107/00* | (2006.01) |

(52) U.S. Cl.

CPC ..... *H01R 43/10* (2013.01); *H01R 39/08* (2013.01); *H01R 39/14* (2013.01); *H01R 2107/00* (2013.01)

(58) Field of Classification Search

CPC ..... A61B 17/1628; A61B 2017/320032; H01R 39/643; H01R 43/12

USPC ..... 29/597, 596, 598, 874; 310/71, 219, 310/232; 439/3, 9, 11, 12, 21, 23, 26, 638

See application file for complete search history.

(56) References Cited

U.S. PATENT DOCUMENTS 6,089,875 A * 7/2000 Iwata et al. ..... 439/26
6,984,915 B2 * 1/2006 Galyean ..... 310/232

FOREIGN PATENT DOCUMENTS

WO 2008/042183 A2 4/2008

OTHER PUBLICATIONS

European Search Report, Mail Date, Nov. 11, 2013, EP 12 16 3401, Application No. 12163401.8-1801 / 2515392 E.

* cited by examiner

*Primary Examiner* — Thiem Phan

(57) ABSTRACT

A process of fabricating a slip ring component, a slip ring component, and a slip ring assembly are disclosed. The process includes forming a first shot, forming a second shot, and immersion bathing the first shot and the second shot. The immersion bathing applies an electrically conductive plating to exposed surfaces of the second shot.

20 Claims, 5 Drawing Sheets

METHOD OF FABRICATING A SLIP RING COMPONENT

FIELD OF THE INVENTION

The present invention is directed to electrical connectors and components, electrical connector assemblies, and processes of fabricating electrical connectors and electrical connector assemblies. More specifically, the present invention relates to slip ring components and assemblies.

BACKGROUND OF THE INVENTION

Electrical connectors provide power and/or signals for various applications. Rotating components present challenges for electrical connectors. Rotating components prevent direct connection of a source to a controller and/or power source due to the rotation of the rotating component. For example, a rotating component directly connected through a wire to a controller becomes twisted and can break or become tangled after one or more revolutions. Connectors having an internal rotor and a stator can be used for such rotating components.

Connectors having a rotor and a stator can include expensive materials and/or can be labor-intensive in fabrication. Molding portions of the housings to form conductive paths and/or adding conductive paths can be labor intensive and, thus, add to the cost of the electrical connectors.

An electrical connector, components of an electrical connector, and a process of fabricating components of an electrical connector not suffering from the above drawbacks would be desirable in the art.

BRIEF DESCRIPTION OF THE INVENTION

In an embodiment, a process of fabricating a slip ring component includes forming a first shot, forming a second shot, and immersion bathing the first shot and the second shot. The immersion bathing applies an electrically conductive plating to exposed surfaces of the second shot.

In another embodiment, a slip ring component includes a first shot, and a second shot. The first shot includes an electrically conductive plating.

In another embodiment, a slip ring assembly includes a rotatable portion, a stationary housing, and one or more slip ring components electrically connecting the rotatable portion to the stationary housing. The one or more slip ring components include a first shot and a second shot. The first shot includes an electrically conductive plating.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary process of fabricating a slip ring component, a slip ring component, and a slip ring assembly including a slip ring component. Embodiments of the present disclosure permit signals and/or power to be transmitted from a rotating source to a controller and/or power source, utilize low and/or lower costs materials, utilize simple and/or simpler fabrication methods and/or assembly methods, and combinations thereof.

Figure 1:
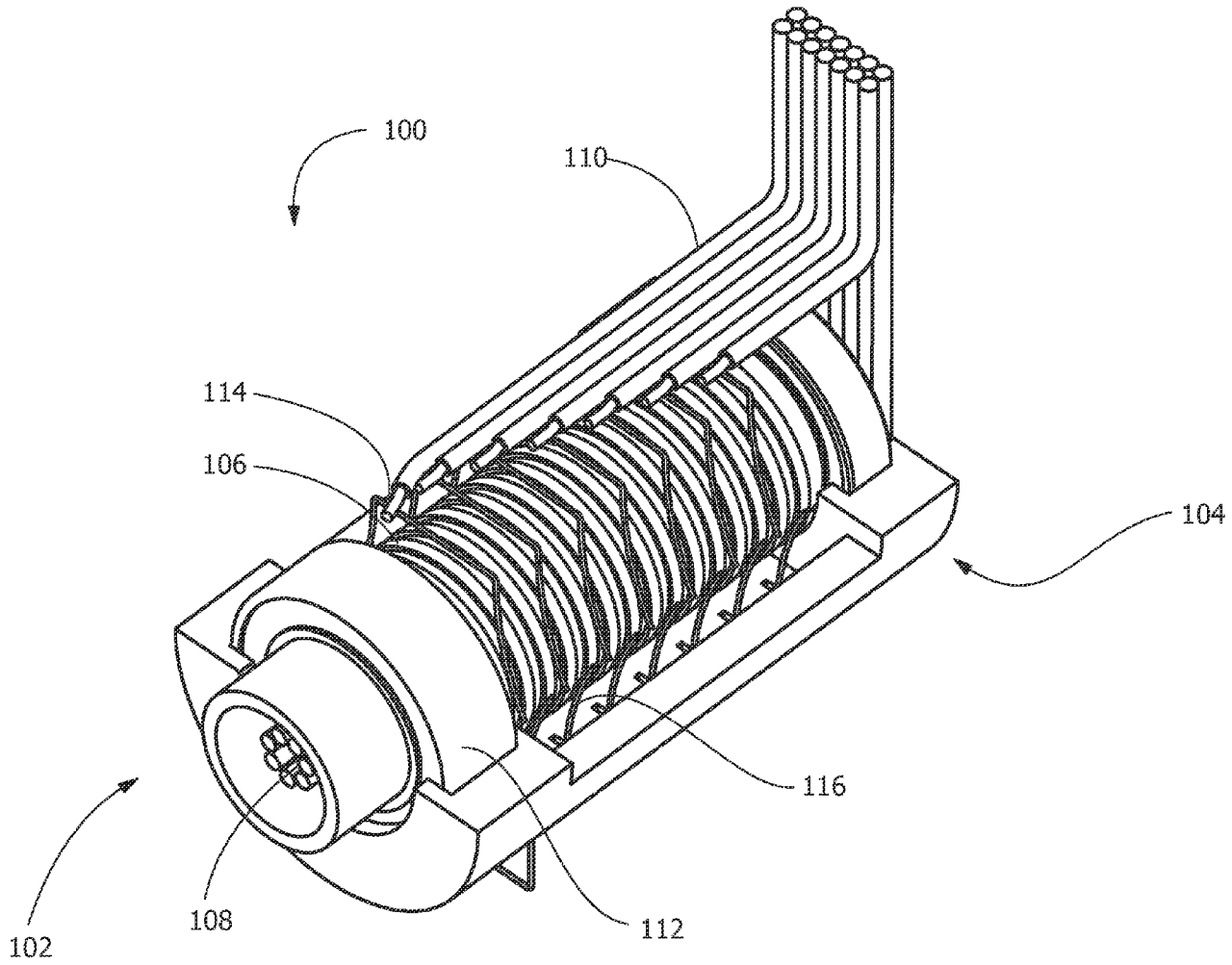
FIG. 1 is a perspective view of an exemplary molded interconnect device according to the disclosure with a stationary housing partially removed for clarity.
Figure 2:
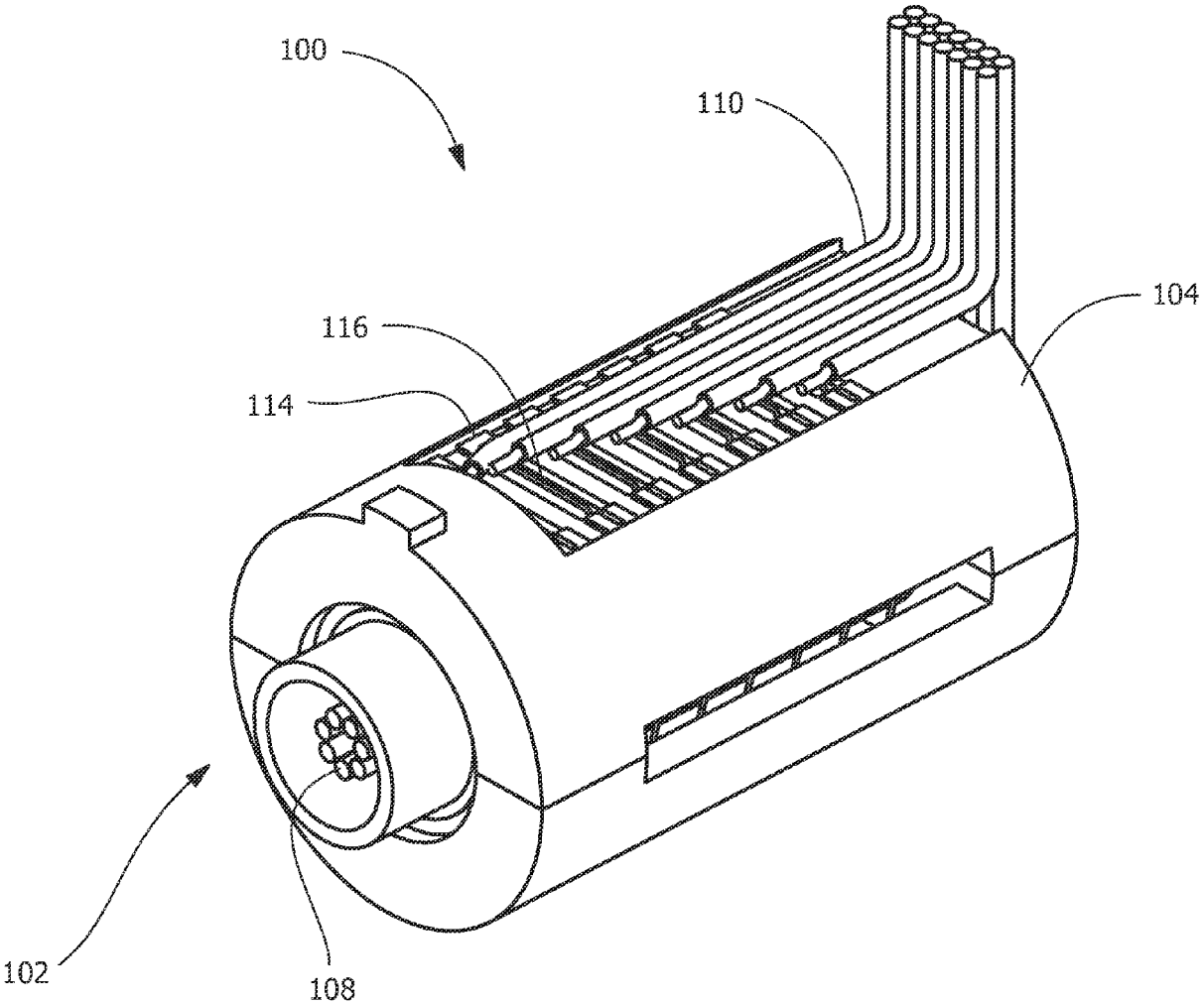
FIG. 2 is a perspective view of an exemplary molded interconnect device according to the disclosure with a stationary housing.

Referring to FIGS. 1 and 2, an exemplary slip ring assembly 100, for example, a molded interconnect device, includes a rotatable portion 102, a stationary housing 104, and one or more slip ring components 106 electrically connecting source wires 108 in the rotatable portion 102 to controller wires 110 in the stationary housing 104. The slip ring assembly 100 receives an electrical signal from one or more interior or the source wires 108 connected to a source (not shown), such as a camera, a rotor for a helicopter, a turbine (for example, a gas turbine, a steam turbine, or a wind turbine), or any other source having a rotating component (not shown). The source wires 108 are electrically connected through the rotatable portion 102 to the one or more slip ring components 106 (see FIG. 1), then to one or more exterior or the controller wires 110 connected to a controller (not shown) and/or a power source. As will be appreciated, in other embodiments, controller wires are capable of being positioned proximal to the rotatable portion 102 and source wires are capable of being positioned proximal to the stationary housing 104.

Figure 3:
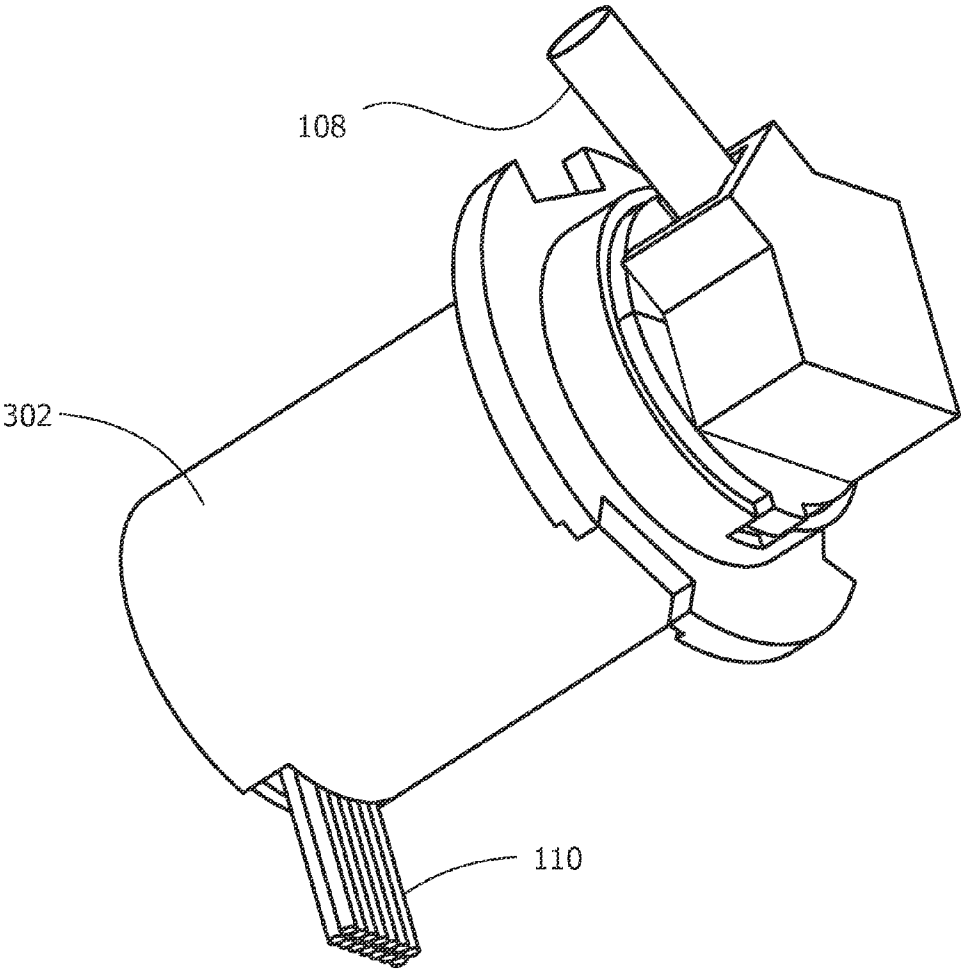
FIG. 3 is a perspective view of an exemplary molded interconnect device according to the disclosure with a covering on a stationary housing.

The stationary housing 104 is any suitable housing capable of containing the rotatable portion 102. The stationary housing 104 includes a semicrystalline polymer. In one embodiment, the housing 104 includes polybutylene terephthalate. In another embodiment, the housing 104 includes a liquid crystal polymer. The housing 104 extends circumferentially around the rotatable portion 102 and prevents the controller wires 110 from exposure to the environment. In one embodiment, referring to FIG. 3, the housing 104 further includes a cover 302 that encloses the electrical connection between the controller wires 110 and the slip ring components 106. The cover 302 further protects the controller wires 110 from exposure to the environment. Additionally or alternatively, in one embodiment, a sealant is applied over the controller wires 110 to protect the controller wires from exposure to the environment.

The housing 104 is any suitable geometry permitting the rotatable portion 102 to rotate, for example, cylindrical, partially cylindrical, having a cylindrical interior but a non-cylindrical exterior, cuboid, other suitable geometries, or combinations thereof. Similarly, the arrangement of the controller wires 110 on the stationary housing 104 is any suitable arrangement. Suitable arrangements include, but are not limited to, having controller wires 110 positioned at substantially opposite portions (for example, at about 180 degrees apart on a cylindrical geometry), having controller wires 110 all positioned together, having controller wires 110 positioned along the entire perimeter of the stationary housing, having controller wires 110 staggered, having controller wires go different directions, or combinations thereof.

As shown in FIG. 2, in one embodiment, the stationary housing 104 covers the slip ring components 106 and exposes the electrical connection between the controller wires 110 and the slip ring components 106. Referring again to FIGS. 1 and 2, the housing 104 includes any features for engaging surfaces or other devices. For example, in one embodiment, to extend the controller wires 110 in a direction parallel or other than parallel with the interior of the housing 104, the housing 104 includes an angled portion, such as a 90 degree angled portion as in FIG. 3, a 60 degree angled portion, a 45 degree angled portion, a 30 degree angled portion, and/or a 15 degree angled portion. In one embodiment, the housing 104 is fixed to another structure (not shown), for example, by fasteners, adhesives, interlocking portions, flanges, other securing mechanisms, or combinations thereof, thereby preventing movement of the housing 104.

The controller wires 110 electrically connect to the source wires 108 in the rotatable portion 102 through any suitable electrical connection mechanism. In one embodiment, the controller wires 110 are connected at contact points 114 to brush wires 116 that individually connect to the slip ring components 106 (see FIG. 1) within the rotatable portion 102. In one embodiment, the controller wires 110 are soldered to the brush wires 116. In another embodiment, the controller wires 110 are mechanically secured to the brush wires 116.

The brush wires 116 maintain physical contact with the slip ring components 106 at one or more locations, thereby maintaining electrical communication. The brush wires 116 remain in electrical communication with the slip ring components 106 during revolution of the rotatable portion 102 (for example, up to about 3 million revolutions). In one embodiment, the brush wires 116 includes a highly conductive metal alloy, such as alloys including gold, and provide low level contact resistance. The brush wires 116 include any suitable mechanism for maintaining electrical communication, including, but not limited to, having low level contact resistance, high yield strength providing a desirable amount of normal force, a predetermined amount of flexibility for providing resistance to bouncing, other suitable features, or combinations thereof.

The rotatable portion 102 is positioned within the housing 104. The rotatable portion 102 has a generally cylindrical geometry and partially or completely rotates within the housing 104. For example, the rotatable portion 102 rotates and/or oscillates in a clockwise direction (as viewed from a source proximal region 504 shown in FIG. 5), a counterclockwise direction (as viewed from the source proximal region 504), or both. In one embodiment, the rotatable portion 102 includes a rotor shaft 103 (FIG. 5) and one or more bearings 112 for promoting substantially consistent movement of the rotatable portion 102 in relation to the rotor shaft 103. The slip ring components 106 are positioned within the rotatable portion 102.

Figure 4:
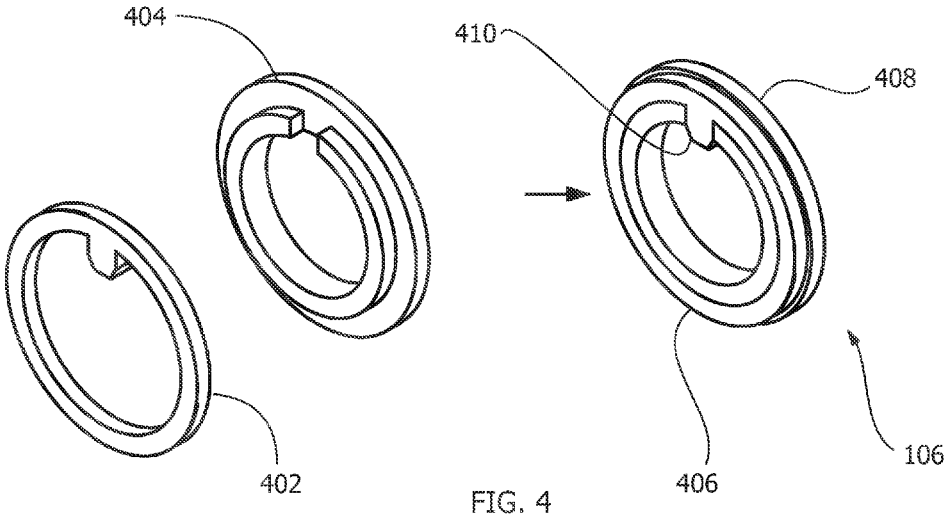
FIG. 4 is a perspective view of an exemplary slip ring component having a non-plateable shot and a plateable shot according to the disclosure.

Referring to FIG. 4, the slip ring components 106 are fabricated by injection molding a second shot 402 (for example, a plateable shot) and injection molding a first shot 404 (for example, a non-plateable shot). As used herein, the term "plateable" refers to being capable of receiving an application of metal through immersion plating techniques. As used herein, the term "non-plateable" refers to being resistant to immersion plating techniques. In one embodiment, the first shot 404 is formed prior to the second shot 402. In one embodiment, the second shot 402 and the first shot 404 bond during the injection molding. In another embodiment, the second shot 402, the first shot 404, and/or the slip ring component 106 are mechanically secured, for example, through keying features, adhesive, ultrasonic welding, and/or an interference fit with each other and/or with the rotatable portion 102. In another embodiment, all or a portion of the second shot 402 is formed with a conductive polymer.

Figure 6:
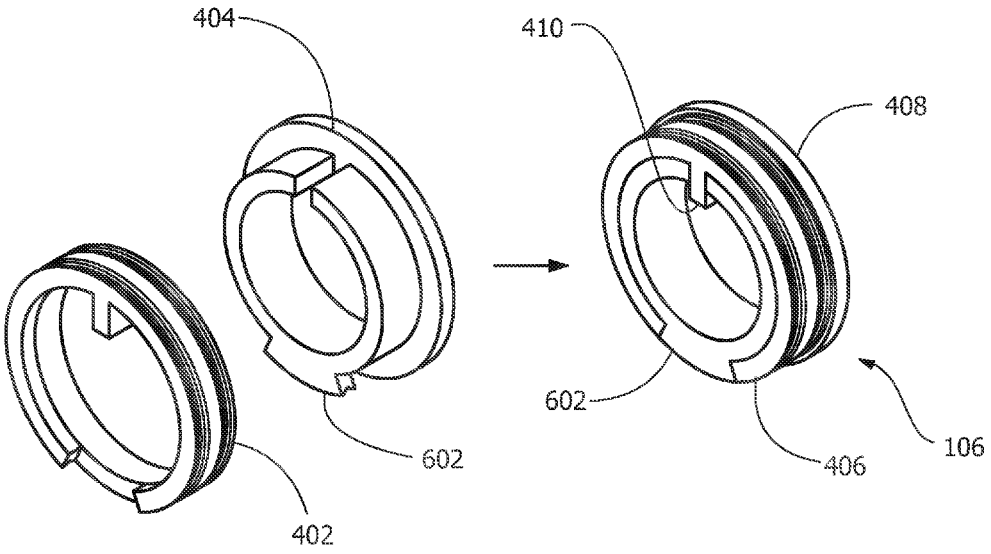
FIG. 6 is a perspective view of an exemplary slip ring component having a non-plateable shot and a plateable shot according to the disclosure.

A plated injection molded portion 406 and an non-plated injection molded portion 408 are formed from the second shot 402 (the plateable shot) and the first shot 404 (the non-plateable shot) and immersion bathed. Exposed surfaces of the non-plated injection molded portion 408 electrically insulate an electrically conductive plating on the plated injection molded portion 406. In one embodiment, the plated injection molded portion 406 includes a contact interface 410. In one embodiment, the contact interface 410 protrudes over at least a portion of the non-plated injection molded portion 408. In another embodiment, the contact interface 410 extends inwardly to the rotor contact 502. Referring to FIG. 6, in one embodiment, the plated injection molded portion 406 includes a protruding insulator feature 602. The protruding insulator feature 602 is positioned opposite the contact interface 410 and electrically breaks connectivity with the brush contacts 116, providing a homing and/or keying function for the rotatable portion 102.

The immersion bathing selectively applies an electrically conductive plating to exposed surfaces of the second shot 402 resulting in the plated injection molded portion 406 being electrically conductive. In one embodiment, the electrically conductive plating has a thickness of between about 2 micro inches and about 100 micro inches, about 5 micro inches and about 30 micro inches, about 10 micro inches and about 20 micro inches, or about 15 micro inches. In one embodiment, the electrically conductive plating includes gold, palladium-nickel, silver, any suitable non-oxidizing noble metal, or combinations thereof.

In one embodiment, the immersion bathing is multi-stage (for example, two-stage, three-stage, or any other suitable number of stages). In one embodiment, the immersion bathing further includes applying a nickel underplating prior to applying the electrically conductive plating. The nickel underplating is any suitable thickness and provides a smooth surface providing wear resistance for the electrically conductive plating. In one embodiment, the thickness of the nickel underplating is between about 500 micro inches and about 700 micro inches, between about 550 micro inches and about 650 micro inches, or about 600 micro inches. In a further embodiment, the immersion bathing includes application of a copper strike layer prior to the nickel underplating application. The copper strike layer has a thickness between about 5 micro inches and about 10 micro inches, about 5 micro inches and about 7 micro inches, or about 5 micro inches.

The non-plated injection molded portion 408 includes exposed surfaces that remain electrically insulating, thereby separating the slip ring components 106 and permitting signals and/or power to be sent from the source wires 108 to the controller wires 110 without electrical interference or shorting. In one embodiment, the exposed surfaces of the non-plated injection molded portion 408 is devoid of the electrically conductive plating.

Figure 5:
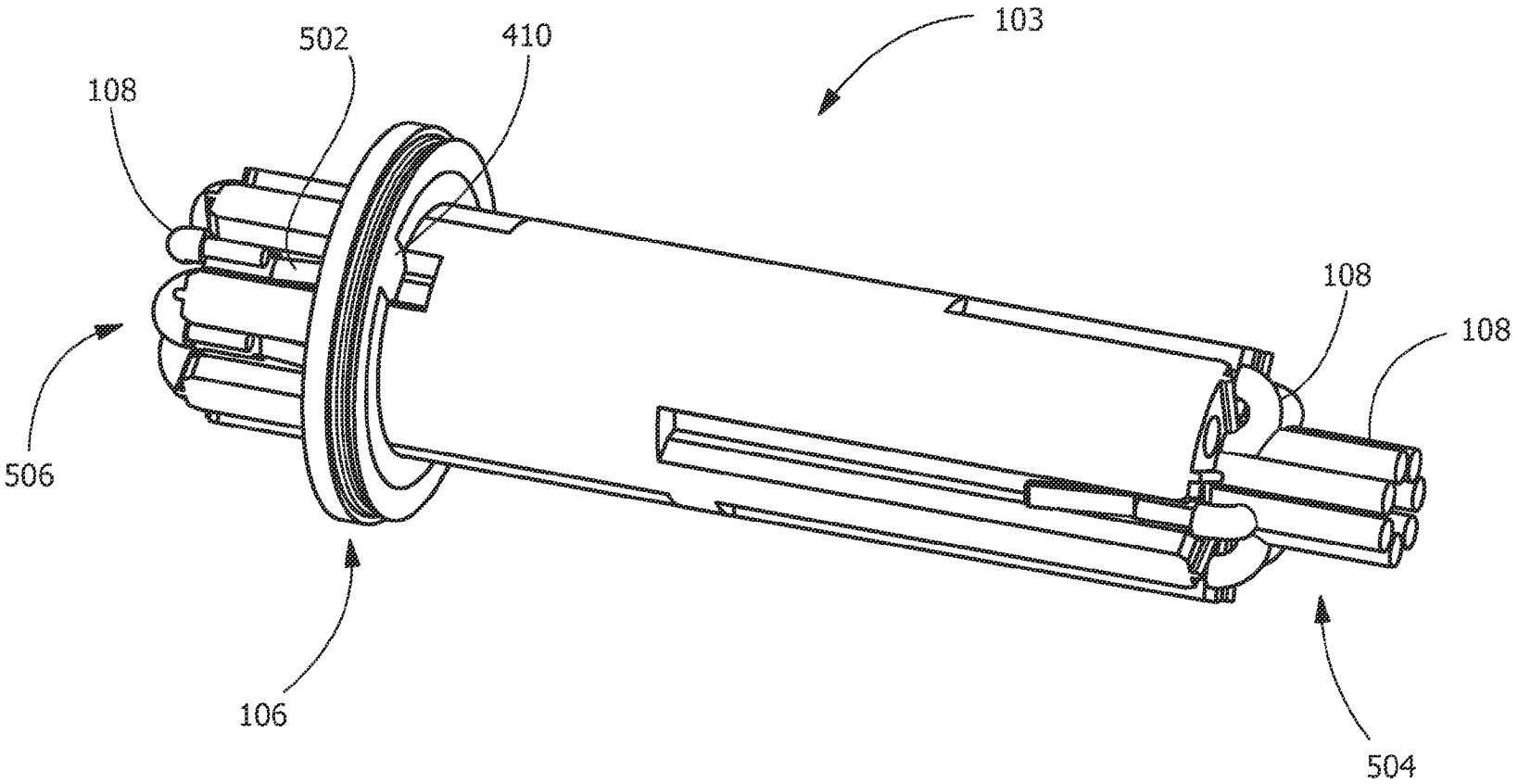
FIG. 5 is a rotor shaft of an exemplary molded interconnect device having one slip ring component positioned and press fit onto the rotor shaft according to the disclosure.

Referring to FIG. 5, upon forming the slip ring component 106, in one embodiment, the slip ring component 106 is positioned on the rotor shaft 103 and secured thereto (for example, friction fit, soldered, or otherwise attached). In a further embodiment, the slip ring component 106 is press fit onto the rotor shaft 103. By press fitting the slip ring component 106 onto the rotor shaft 103 the source wires 108 proximal to the rotatable portion 102 and controller wires 110 proximal to the stationary housing 104 are in electrical communication. In a further embodiment, one or more additional slip ring components 106 (for example, totaling 7 slip ring components, 14 slip ring components, or any other suitable number of slip ring components) are positioned and/or press fit on the rotor shaft 103.

In one embodiment, the slip ring component 106 includes keying or features corresponding to the geometry of the rotor shaft 103 at a predetermined axial position. In a further embodiment, the additional slip ring components 106 include differently positioned keying or features corresponding to the geometry of the rotor shaft 103 at additional predetermined axial position. As shown in FIG. 5, in one embodiment, rotor contacts 502 on the rotor shaft 103 have varying lengths corresponding to the position of a predetermined slip ring component 106 permitting the contact interface 410 to electrically connect the slip ring component 106 to the corresponding source wire 108. In one embodiment, the rotor contacts 502 permit the source wires 108 to be electrically connected to slip ring components 106 positioned at a source proximal region 504 that is relatively closer to where the source wires 108 enter the slip ring assembly 100 in comparison to a source distal region 506 that is relatively farther from where the source wires 108 enter the slip ring assembly 100.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A process of fabricating a slip ring component, the process comprising:

forming a first shot;

forming a second shot;

securing the first shot and the second shot together; then immersion bathing the first shot and the second shot; then positioning the slip ring component on a rotor shaft;

wherein the first shot is non-plateable and the second shot is plateable; and wherein the immersion bathing selectively applies an electrically conductive plating to exposed surfaces of the second shot but not the first shot;

wherein the slip ring component has a contact interface on the second shot extending inwardly toward the rotor shaft such that the contact interface protrudes over at least a portion of the first shot.

2. The process of claim 1, wherein one or more of the forming of the first shot and the forming of the second shot is by injection molding.

3. The process of claim 1, wherein one or more of the forming of the first shot and the forming of the second shot is by machining.

4. The process of claim 1, wherein exposed surfaces of the first shot electrically insulate the conductive plating of the second shot.

5. The process of claim 1, wherein the exposed surfaces of the first shot are devoid of the electrically conductive plating.

6. The process of claim 1, wherein the electrically conductive plating includes gold.

7. The process of claim 1, wherein the immersion bathing includes nickel underplating prior to applying the electrically conductive plating.

8. The process of claim 7, wherein the immersion bathing includes copper striking prior to the nickel underplating.

9. The process of claim 1, wherein the forming of the second shot bonds the first shot to the second shot.

10. The process of claim 1, further comprising press fitting the slip ring component onto the rotor shaft.

11. The process of claim 1, further comprising securing the slip ring component onto the rotor shaft by ultrasonic welding.

12. The process of claim 1, further comprising securing the slip ring component onto the rotor shaft by adhesive.

13. The process of claim 1, further comprising securing the slip ring component onto the rotor shaft by an interference fit.

14. The process of claim 1, further comprising positioning one or more additional slip ring components onto the rotor shaft.

15. The process of claim 1, wherein the slip ring component has a protruding insulating feature positioned opposite the contact interface.

16. The process of claim 1, wherein the slip ring component has a planar surface of the first shot being co-planar with a planar surface of the second shot.

17. A process of fabricating a slip ring component, the process comprising:

forming a first shot;

forming a second shot with a conductive polymer; and immersion bathing the first shot and the second shot; then positioning the slip ring component on a rotor shaft;

wherein the immersion bathing applies an electrically conductive plating to exposed surfaces of the second shot; and wherein the first shot electrically insulates the electrically conductive plating on the second shot;

wherein the slip ring component has a contact interface on the second shot extending inwardly toward the rotor shaft such that the contact interface protrudes over at least a portion of the first shot.

18. The process of claim 17, wherein the securing comprises bonding the first shot to the second shot during injection molding.

19. The process of claim 17, wherein the securing comprises mechanically securing the first shot to the second shot.

20. A process of fabricating a slip ring component, the process comprising:

injection molding a first shot, the first shot being resistant to immersion plating;

injection molding a second shot, the second shot being capable of receiving an application of metal through immersion plating;

securing the first shot and the second shot together, the securing being selected from the group consisting of bonding during injection molding, keying features, adhesive, ultrasonic welding, interference fit, and combinations thereof; then immersion bathing the first shot and the second shot; then positioning the slip ring component on a rotor shaft;

wherein the immersion bathing selectively applies an electrically conductive plating to exposed surfaces of the second shot but not the first shot; and wherein the second shot includes a contact interface, the contact interface protruding over at least a portion of the first shot.

* * * * *